US007007322B2

(12) United States Patent
Alane

(10) Patent No.: US 7,007,322 B2
(45) Date of Patent: Mar. 7, 2006

(54) YOGA/EXERCISE MAT

(76) Inventor: Dawnn Alane, 15332 Antioch St., #216, Pacific Palisades, CA (US) 90272

( * ) Notice: Subject to any disclaimer, the term of this patent is extended or adjusted under 35 U.S.C. 154(b) by 0 days.

(21) Appl. No.: 10/698,639

(22) Filed: Oct. 31, 2003

(65) Prior Publication Data

US 2004/0088788 A1 May 13, 2004

Related U.S. Application Data

(63) Continuation-in-part of application No. 10/245,570, filed on Sep. 17, 2002, now Pat. No. 6,640,359.

(51) Int. Cl.
*A47G 9/06* (2006.01)

(52) U.S. Cl. ..... 5/417

(58) Field of Classification Search ..... 5/417–420, 5/655, 656; D6/596, 602, 603, 606, 607, D6/582

See application file for complete search history.

(56) References Cited

U.S. PATENT DOCUMENTS

| | | | | | |
|---|---|---|---|---|---|
| 1,237,243 | A | * | 8/1917 | Conner | 5/420 |
| 1,951,527 | A | * | 3/1934 | Oas | 5/417 |
| 3,489,194 | A | * | 1/1970 | Hoover | 5/655 |
| 3,976,113 | A | * | 8/1976 | Kim | 383/4 |
| 4,097,944 | A | * | 7/1978 | Yulish | D6/603 |
| 4,468,810 | A | * | 8/1984 | Longo | 5/417 |
| 5,035,013 | A | * | 7/1991 | Bloom | 5/420 |
| D318,772 | S | * | 8/1991 | Phillips | D6/603 |
| 5,059,463 | A | * | 10/1991 | Peters | 135/116 |
| D330,139 | S | * | 10/1992 | Bloom | 5/655 |
| D341,513 | S | * | 11/1993 | Reeves et al. | D6/596 |
| D346,923 | S | * | 5/1994 | Holm | D6/596 |
| D376,287 | S | * | 12/1996 | Bennett | D6/596 |
| 5,692,257 | A | * | 12/1997 | Albertieri | 5/655 |
| D391,109 | S | * | 2/1998 | Miller | D6/596 |
| 5,720,057 | A | * | 2/1998 | Duncan | 5/420 |
| 5,785,427 | A | * | 7/1998 | Godshaw | 5/656 |
| 6,189,169 | B1 | * | 2/2001 | Marcotte | 5/655 |
| 6,192,536 | B1 | * | 2/2001 | Connors | 5/656 |
| 6,408,463 | B1 | * | 6/2002 | Palacio | 5/655 |
| D478,455 | S | * | 8/2003 | Papazian | D6/596 |
| D479,938 | S | * | 9/2003 | Quirk et al. | D6/603 |
| 6,640,359 | B1 | * | 11/2003 | Alane | 5/420 |

OTHER PUBLICATIONS

Hugger Mugger yoga product, internet website, Jun. 1, 2002.*

* cited by examiner

*Primary Examiner*—Michael Safavi
(74) *Attorney, Agent, or Firm*—Lewis Brisbois; Bisgaard & Smith LLP; Sanford Astor, Esq.

(57) ABSTRACT

A yoga mat that may be rolled up tightly and then held closed by straps, which wrap around and encircle the rolled up mat. The straps are affixed to the mat by the ends thereof being sewn to the edge of mat under an attachment strip, which fits along one entire edge of the mat. A shoulder strap is also attached under the attachment strip between the two straps, so that the mat can be carried over the shoulder with both hands and arms free.

9 Claims, 2 Drawing Sheets

YOGA/EXERCISE MAT

This is a continuation-in-part of my application Ser. No. 10/245,570, filed Sep. 17, 2002, now U.S. Pat. No. 6,640, 359.

BACKGROUND OF THE INVENTION

Yoga is and has always been a popular practice for many people. Today it has become even more popular and is practiced by millions of people in the United States alone (Time Magazine 2001). People attending yoga classes bring their own yoga mats since a person must have a yoga mat to practice yoga. Most persons have great difficulty in carrying their yoga mats because mats need to be rolled up. Yoga mats are awkward in size and shape so they are usually carried under the armpit. Yoga students attending classes also carry their personal belongings, purses, backpacks, keys, towels, books, computers, etc. and it is quite difficult for them to keep their yoga mats rolled up tightly enough to stay under their arms without the mats sliding down and eventually unrolling and falling to the ground.

While yoga backpacks and carry bags do exist, they are too much trouble, because a person has to carefully fold and unfold the yoga mat just to get it in and out of the backpack or bag. In addition, the yoga mat becomes odor filled and moldy, from perspiration, dirty yoga room floors and body odor. Then, after a yoga class, stuffing this mat into a carry bag to be stored, does not allow fresh air to clear the odor. The yoga mat of this invention is simple, quick and easy to roll up and carry and to roll out for class.

In my prior application I described a yoga mat manufactured from a single piece of material in which the securing straps were an integral part of the original part of the material. While that method of manufacture of my yoga mat has certain advantages, another method of manufacture and assembly of the yoga mat has other and different advantages.

BRIEF SUMMARY OF THE INVENTION

Applicant's invention comprises a yoga mat that is able to be rolled up tightly and then secured, so that it will not unroll, and that also has a shoulder carry strap permanently attached, so that the mat can be carried like a purse, briefcase or bag, with both hands and arms free. The securing straps that close and hold the mat securely rolled up may be made of the same material as the mat or may be made of other materials, trims, knits, or fabrics, and are securely fastened to the mat by a covering attachment strip and sewing. The shoulder strap is positioned between the securing straps and is secured by the covering attachment strip and sewing.

The yoga mat of this invention is washable. It easily rolls and unrolls with two streamlined straps. The straps circle around the rolled up mat and connect with a hook and loop fastener (Velcro), or other closure, with just a sweep of the hand. The shoulder strap enables the user to sling the rolled up mat over his or her shoulder and have both arms and hands free.

OBJECTS OF THE INVENTION

Accordingly, several objects and advantages of the invention are as follows:

It is an object of the present invention to provide a yoga mat which is easily and simply rolled up for easy and effortless carrying and transportation.

Another object of the invention is to provide a yoga mat in which straps are secured to the mat that are used to hold and keep the mat in its rolled up state.

These, as well as other objects of the invention, will become obvious from the following description in which:

DETAILED DESCRIPTION OF THE INVENTION

Figure 1:
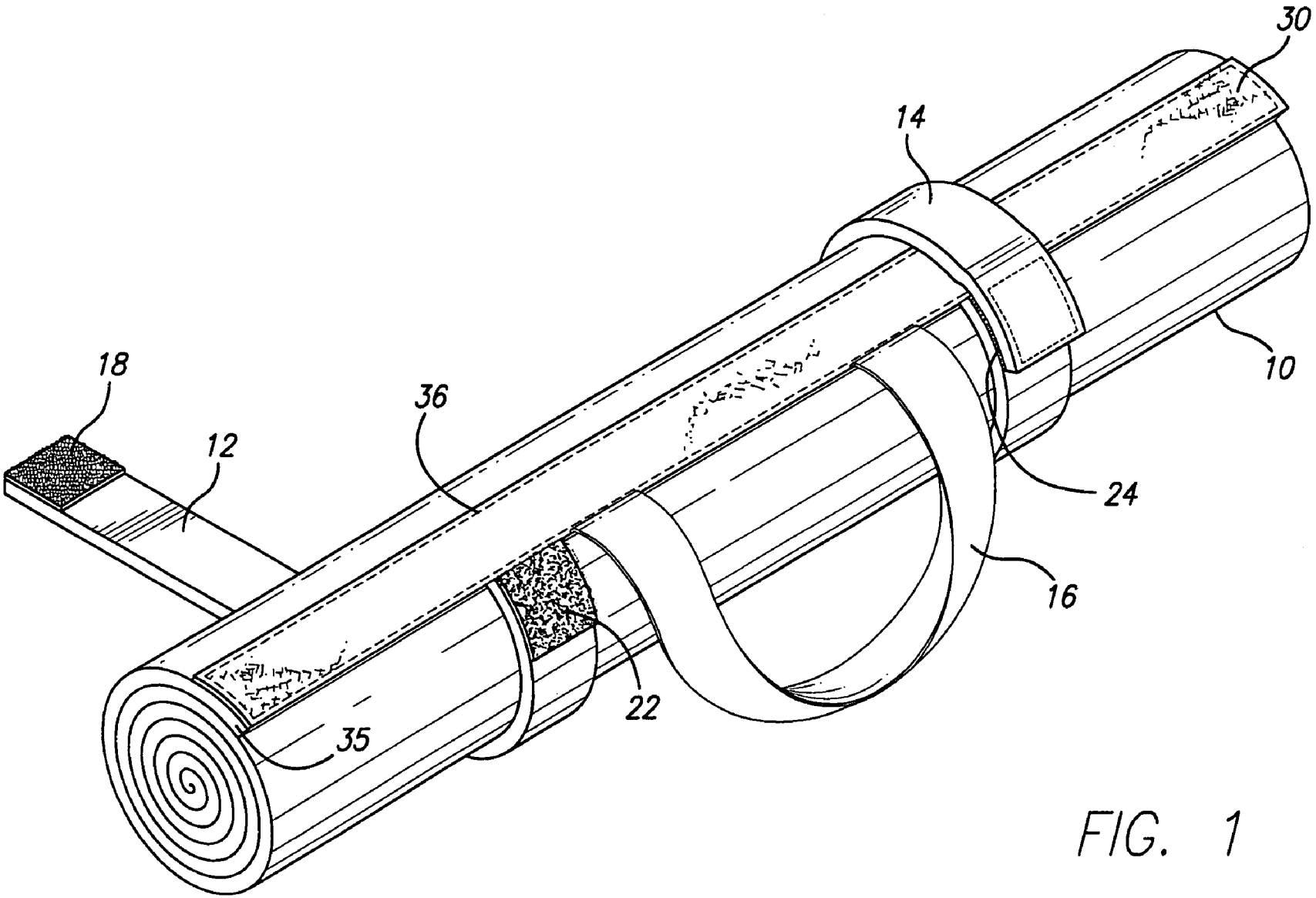
FIG. 1 is a perspective view of the rolled up mat.
Figure 2:
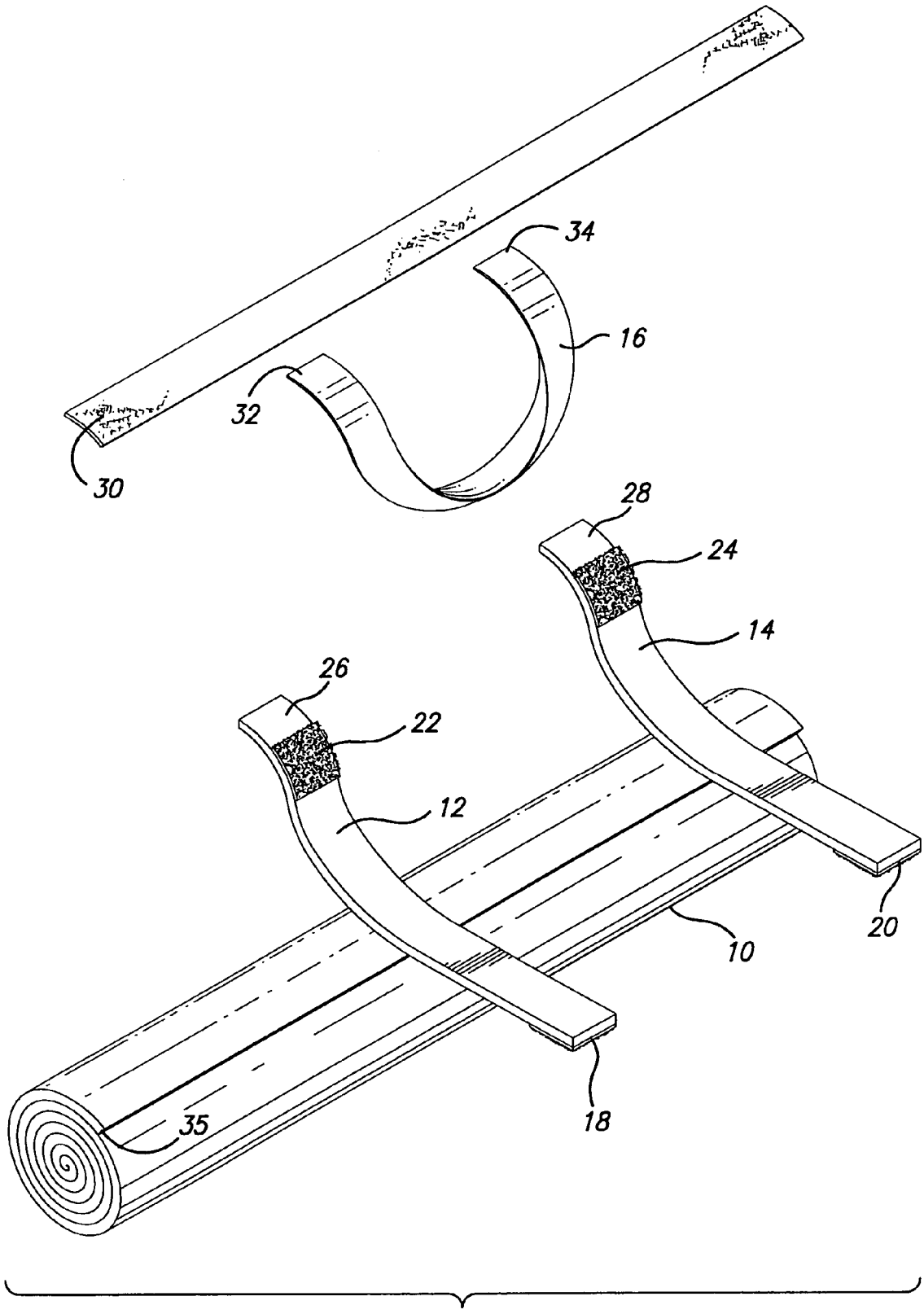
FIG. 2 is an exploded view of the mat and straps.

Referring now to the drawings, there is shown a rolled up yoga mat 10 comprising an elongated surface area of mat material. Yoga mats are generally rectangular but may come in other shapes and sizes. Two relatively narrow elongated straps 12 and 14 and shoulder carry strap 16 are fixedly attached to one end of yoga mat 10. Shoulder strap 16 is affixed between straps 12 and 14.

At the ends of straps 12 and 14 are affixed means to hold yoga mat 10 in the rolled up position. These are hook and loop fasteners 18 and 20 which connect to opposite hook and loop fasteners 22 and 24. As can be seen, fasteners 18 and 20 are on one side and one end of each strap 12 and 14 and fasteners 22 and 24 are near the opposite end of each strap, 12 and 14 (but not at the end) and on the opposite side of each strap, so that they can lock together when they encircle the rolled up mat, as shown in FIG. 1. A portion of the end of each strap 26, 28 comprises an end tab, used to attach the straps 12, 24 to mat 10. While two straps are shown and are sufficient, a plurality of straps, such as three or four straps could be used if desired.

As shown more clearly in FIG. 1, when yoga mat 10 is rolled up, straps 12 and 14 encircle the rolled up mat 10 and attach at fasteners 18–22 and 20–24. Other fasteners could be used, such as buttons, clips, buckles, snaps or ties, however a hook and loop fastener is faster, easier and has some degree of adjustment if the mat 10 is not rolled up as tightly, from one time to another.

Straps 12 and 14 hold yoga mat 10 in its rolled up state. A person could carry the rolled up mat by strap 16 or could also throw strap 16 over his or her shoulder and carry mat 10 in that manner, leaving his or her arms and hands free. Strap 16 could be made adjustable in length by the use of hook and loop fasteners, buckles, adjustable straps or other adjustment means.

Straps 12 and 14 and shoulder strap 16 are all affixed to mat 10 by an attachment strip 30. The end tabs 26 and 28 and the ends 32 and 34 of shoulder strap 16 are all placed in position over the edge 35 of mat 10. Attachment strip 30 is placed over the top of the strap ends 26, 28, 32 and 34 and is sewn to mat 10 completely around the periphery of attachment strip 30. The stitching 36 runs completely through the ends 26, 28, 32 and 34 of straps 12, 14 and 16 so that they are fixedly attached to the end of mat 10. Attachment strip 30 is equal in length to the width of the mat 10 to which it is attached, so that it runs completely along the edge 35 of mat 10. Attachment strip 30 may be attached by other means, such as by an adhesive, but sewing is preferred.

Hook and loop fasteners 22 and 24 could extend to the ends of straps 12 and 14 and be attached underneath attachment strap 30. However, a bulge would occur, so that the presence of the end tabs 26 and 28 is preferred.

Yoga mat 10 can be made from any usual substance from which exercise mats are made. The preferred material is a soft polyvinyl chloride, also known as a "closed-cell pvc vinyl" which is available from many catalog companies, yoga studios and stores, including the Hugger Mugger Co. of Salt Lake City, Utah. It is a particularly good material for yoga mats because it has a tacky, non-slick surface, which prevents sliding on the surface of the mat. The mat may also be made of rubber, a rubber-like material or a fabric, preferably a moisture absorbent fabric. Sliding is not acceptable when practicing yoga, especially based on the amount of perspiration created in a hot yoga room. Yoga rooms are required to be kept at a relatively warm temperature to allow a person's body to get warm quickly and be flexible and strong for yoga postures.

A yoga mat manufactured as described herein, will last for years. It is durable, comfortable, completely washable, and the straps will never come loose. No sports bag, backpack, harness, other carry bag or other accessories are needed to transport the yoga-mat.

Having thus described the invention, I claim:

1. A generally rectangular yoga mat comprising an elongated surface area, two elongated straps, one end of each strap having an end tab and a hook and loop fastener adjacent to the end tab, the other end of each strap having a hook and loop fastener attached to the opposite side thereof, a carry strap attached to the edge of the mat between the two straps, an attachment strip fixedly attached to one edge of the yoga mat, said attachment strip extending the entire length of the mat, the end tab of each strap and both ends of the carry strap being fixedly affixed between the mat and the attachment strip in which the attachment strip is fixedly attached to the mat by sewing or adhesive.

2. The mat of claim 1 in which the mat is made from soft polyvinyl chloride vinyl, rubber, rubber-like material or a moisture absorbent fabric.

3. The mat of claim 1 in which the attachment strip is attached to the mat by sewing around the entire periphery of the attachment strap.

4. The mat of claim 1 in which the carry strap is adjustable.

5. A yoga mat comprising an elongated surface area, a plurality of elongated straps, one end of each strap having an end tab and a fastener adjacent to the end tab, the other end of each strap having a fastener attached thereto, a carry strap attached to the end of the mat between the elongated straps, an attachment strip fixedly attached to one edge of the yoga mat, the end tab of each strap and the ends of the carry strap all being fixedly affixed between the mat edge and the attachment strip, the attachment strip being fixedly attached to the mat by sewing or adhesive.

6. The mat of claim 1 in which each fastener is a hook and loop fastener.

7. The mat of claim 1 in which the mat is made from soft polyvinyl chloride vinyl, rubber, a rubber-like material or a moisture absorbent fabric.

8. The mat of claim 1 in which the attachment strip is attached to the mat by sewing around the entire periphery of the attachment strap.

9. The mat of claim 1 in which the carry strap is adjustable.

* * * * *